United States Patent [19]

Gatby

[11] 4,114,216

[45] Sep. 19, 1978

[54] COMBINATION TOOL

[76] Inventor: Sven-Olof Gatby, Strandgatan 3, 794 00 Orsa, Sweden

[21] Appl. No.: 767,194

[22] Filed: Feb. 9, 1977

[30] Foreign Application Priority Data

Feb. 10, 1976 [SE] Sweden ..... 7601403

[51] Int. Cl.[2] ..... B25F 1/04

[52] U.S. Cl. ..... 7/116; 81/177 A; 7/145; 7/148; 7/167

[58] Field of Search ..... 7/13 R, 14.1 R, 14.55, 7/1 R, 1 L; 81/177 A

[56] References Cited

U.S. PATENT DOCUMENTS

| | | | |
|---|---|---|---|
| 2,047,485 | 7/1936 | McBrady | 7/14.55 UX |
| 4,023,221 | 5/1977 | Cadman | 7/14.55 X |

*Primary Examiner*—Al Lawrence Smith
*Assistant Examiner*—James G. Smith
*Attorney, Agent, or Firm*—Pollock, Vande Sande & Priddy

[57] ABSTRACT

Combination tool comprising an elongated tubular handle; one or several individual or combined tool members adapted to be inserted into at least one end of said handle; and a locking device for releasably connecting said tool members to said handle. The combination tool is characterized by two opposite slots at at least one end of said handle; a support block fixed to the outer surface of said handle and covering one of said slots; stop means fixed to at least one side of the tool members for engagement with the inner surface of the handle opposite to the slot covered by the support block; said locking device comprising a leaf spring fixed to the outer surface of the handle; a transverse locking pin fixed to at least one end of said leaf spring; at least one transverse aperture in said handle; and at least one groove in the back edge of the tool member, said groove having a shape complementary to the locking pin.

6 Claims, 5 Drawing Figures

COMBINATION TOOL

The present invention relates to a combination tool which in the first place is intended for use as a rescue and clearing tool.

In emergency situations such as when braking up crashed vehicles to rescue entrapped vehicle occupants a plurality of individual heavy duty tools such as axes, saws, claw bars, cutting torches, etc. are often needed. Because such tools are heavy and bulky, they have normally been used only in heavier rescue and emergency vehicles.

It is therefore an object of the present invention to provide a combination tool which (a) offers a plurality of tool combinations (b) can be quickly assemblied to the desired tool combination (c) ensures a steady attachment and locking of each tool member, and (d) provides for a light and compact tool unit such that it can be easily stored within smaller emergency vehicles such as ambulances and police cars or other vehicles such as automobiles, buses, trucks, trains, boats, aircraft, etc. or even be carried in a case attached to a waist belt.

Previously known combination tools do not meet all the above requirements due to serious drawbacks as to, in particular, the attachment and locking of the tool members to the handle, which makes these combination tools incapable of resisting such heavy stresses as tools of this kind should be able to cope with.

The combination tool according to the present invention comprises an elongated tubular handle having preferably a rectangular cross-section; one or several individual or combined flat tool members such as axe blades, saw blades, knife blades, files, spade blades, plate cutters, nail claws or the like adapted to be inserted into at least one end of said handle; and a locking device for releasably connecting said tool members to said handle. The combination tool of the present invention is characterized by two opposite slots at at least one end of said handle; a support block fixed to the outer surface of said handle and covering one of said slots; stop means fixed to at least one side of the tool members for engagement with the inner surface of the handle opposite to the slot covered by the support block; said locking device comprising a leaf spring fixed to the outer surface of the handle; a transverse locking pin fixed to at least one end of said leaf spring; at least one transverse aperture in said handle; and at least one groove in the back edge of the tool member, said groove having a shape complementary to the locking pin, whereby said locking pin is biased by the leaf spring toward a position in which it rests in said transverse aperture and engages the groove in the tool member thereby to securely lock the tool member to said handle.

The accompanying drawings and the following description illustrate and describe a practical and preferred embodiment of the invention.

Figure 1:
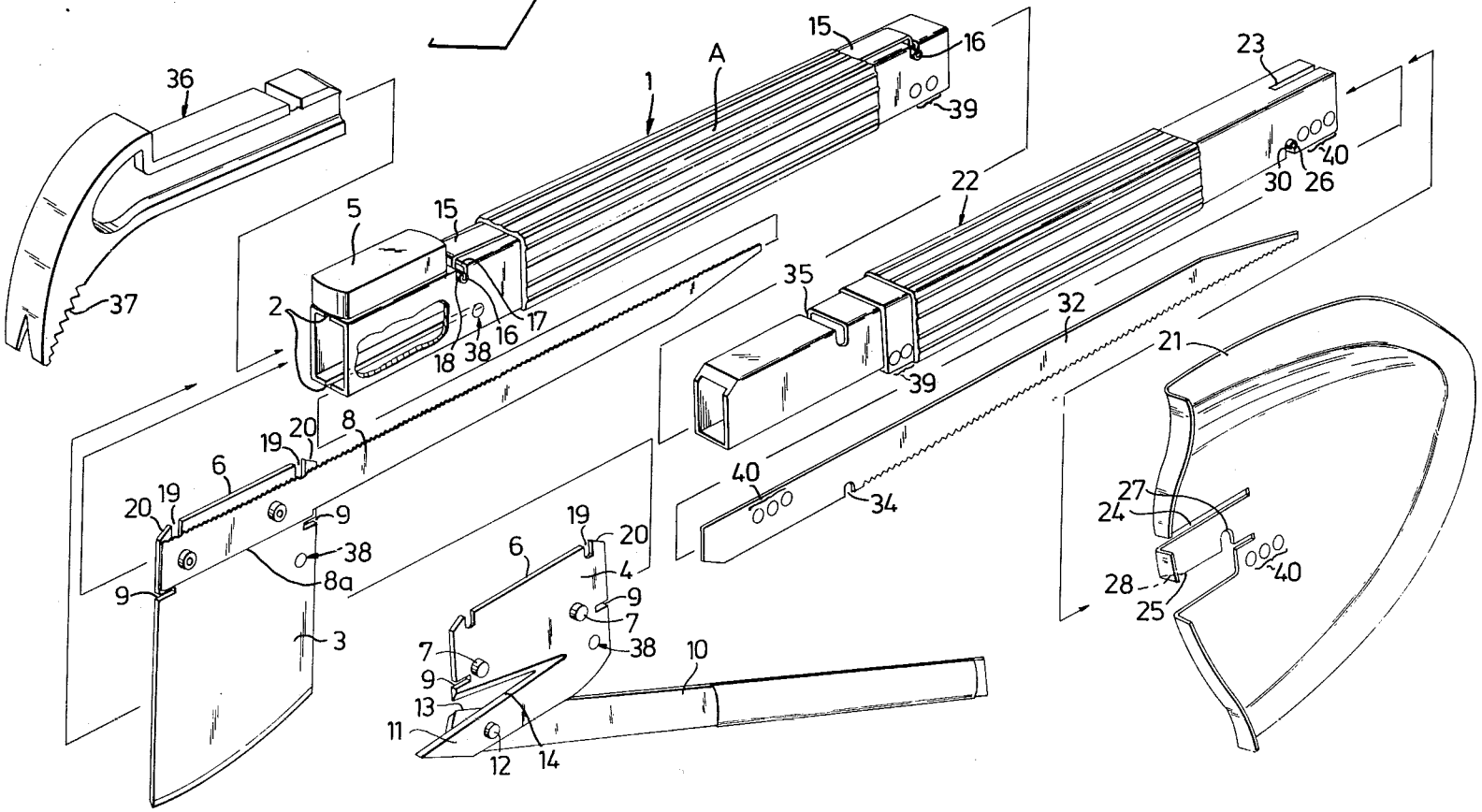
FIG. 1 is a perspective exploaded view of the handle and an axe blade, saw blades, a plate cutter, a nail claw, an extension handle and a spade blade attachable thereto.

As best shown in FIG. 1, the combination tool of the present invention comprises a tubular steel handle 1 of preferably rectangular cross-section. At least one end of the handle 1 has two opposite slots 2 in which various flat tool members such as an axe blade 3 or a plate cutter 4 are adapted to be inserted and fixed in a transverse direction. A support block 5 covering one of the slots 2 is fixedly secured on the outer surface of the handle 1. The support block 5 may have the shape of a hammer head and serves as a support for the back edge 6 of the tool members 3 and 4 to prevent said tool members from sliding up through the upper slot 2.

Figure 4:
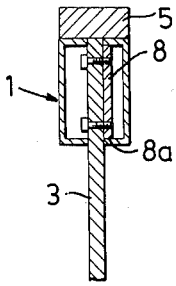
FIG. 4 is a cross-sectional view taken along the line IV—IV in FIG. 2.

In order to prevent the tool member 3 or 4 from sliding out through the lower slot 2, at least one of the sides of the tool member is provided with stop means. As shown in FIG. 1, such stop means may have the shape of pins 7 which extend through the plate cutter 4 or constitute the back edge **8*a* of a saw blade 8 fixed to the axe blade 3 (FIG. 4). The side of the axe blade 3 remote from the saw blade 8 may also be provided with a stop means. All stop means are adapted to rest against the inner surface of the bottom wall of the handle 1**.

Figure 2:
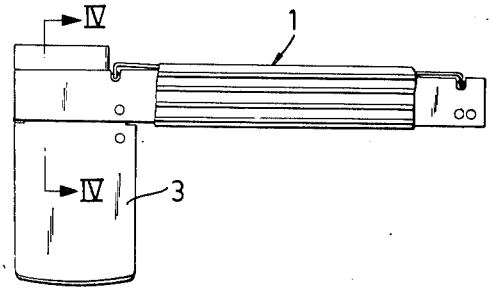
FIG. 2 shows the tool as used as an axe with the saw blade fixed thereto and inserted into the handle.
Figure 3:
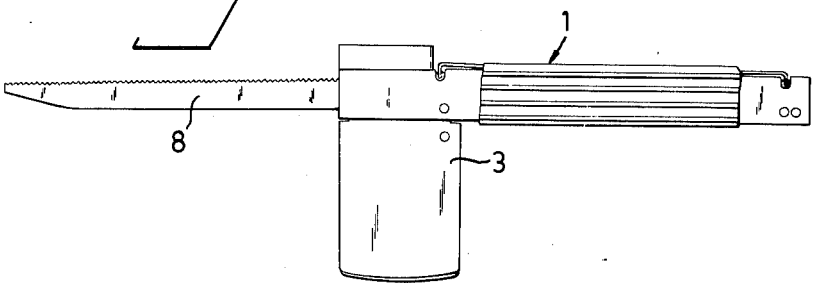
FIG. 3 illustrates the tool as used as a saw.

The side edges of the tool members 3 and 4 have U-shaped notches 9 for engagement with the handle 1 directly beyond the inner end of the lower slot 2. Since both side edges of the tool members 3 and 4 are provided with such notches 9 the tool member may be inserted in the handle located in either of two opposite directions. The combined axe blade and saw blade tool may thus be either attached to the handle with the saw blade 8 inserted into handle as shown in FIG. 2 or the saw blade 8 may project out from the handle 1 as shown in FIG. 3. The back edge **8*a* of the saw blade 8 is preferably oriented perpendicular to the side edge of the axe blade 3 facing the tip of the saw blade to form a set square. The back edge of the portion of the saw blade 8 projecting from the axe blade 3** may have the form of a graduated rule if desired.

Also the plate cutter 4 may be inserted either turned forward or backward relative to the handle 1 depending on which direction the plate is to be cut up. The plate cutter may also be provided with a thread cutting lever 10 which may detachably mounted in a hole in the lower jaw 11 of the plate cutter 4 by means of a pivot pin 12. The lever 10 has a cutting edge 13 which interacts with the cutting edge 14 of the plate cutter 4.

The combination tool of the present invention also comprises a locking mechanism which intimately cooperates with the respective tool member so as to provide a quick, positive and reliable locking of the tool member to the handle. The lcoking mechanism comprises a leaf spring 15 which is fixed to the outer surface of the handle 1 by a shrunk-on plastic cover A. At least one end of said spring 15 carries a transverse locking pin 16. The handle 1 has at least one transverse aperture 17 which forms a U-shaped seat 18 in each adjacent side wall of the handle 1. The locking pin 16 is biased by the leaf spring 15 toward the seats 18 and into engagement with a complementary shaped transverse groove 19 in the back edge 6 of the tool member 3 or 4 inserted into the handle 1. The corners 20 between the back and side edges of the tool member are bevelled so as to provide for automatic locking of the tool member when inserting the latter into the handle, whereby the locking pin 16 is first lifted by the bevelled corners 20 and then snaps into the groove 19. The ends of the locking pin 16 preferably project from the side walls of the handle to make it easy to release the tool member from the handle.

Figure 5:
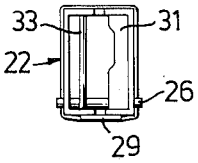
FIG. 5 is an end view of the right end of the extension handle in FIG. 1.

According to a suitable embodiment of the invention, a flat tool member in the shape of a spade blade 21 may be releasably secured to the end of the handle opposite to the support block 5. However, since the handle 1 is relatively short to achieve a compact disassembled unit, it is desirable to connect spade blade 21 on the end of an extension handle 22 (FIG. 1). To this end, the one end of the extension handle 22 has two opposite slots 23 through which the spade blade may be inserted, while the spade blade 21 has two parallel, axial slots 24 and 25 interacting with the slots 23. The slot 25 is widened up to a transverse groove 27 to permit insertion of a locking pin 26 which is adapted to interact with the groove 27. The locking pin 26 carried by one end of a leaf spring 29 (FIG. 5) fixed to the outer surface of the extension handle 22 is lifted by a ramp 28 against the action of the spring 29 before snapping into the groove 27. As shown in FIG. 5, a support piece 31 is fixed to one inner side wall of the extension handle 22 to provide for a support for the rear side of the spade blade 21.

Alternatively, an additional hard metal saw blade 32 may be inserted into and locked at the same end of the extension handle 22. The saw blade 32 is insertable between a guide pin 33 (FIG. 5) and the side wall of the handle opposite to the support piece 31, while the locking pin 26 is adapted to engage with a groove 34 in the blade 32.

The opposite end of the extension handle 22 has a cross-section which fits into the main handle 1, and the locking pin 16 at the end of the main handle 1 opposite to the slots 2 is adapted to snap into a transverse slot 35 in the extension handle 22 to lock the latter to the main handle 1.

Furthermore, if desired, a nail claw 36 (FIG. 1) can be attached to the handle 1. Said nail claw 36 may have teeth 37 to improve the grip action thereof.

In order to make it easy to assemble the combination tool the handles 1 and 22 on one hand and the tool members 3, 4, 21, 32 and 36 on the other may be marked with corresponding position symbols 38, 39 and 40.

I claim:

1. In a combination tool comprising an elongated tubular handle, and a plurality of tool members each adapted to be inserted into at least one end of said handle, a locking means for releasably connecting said tool members to said handle comprising:

two opposite slots at at least one end of said handle;

a support block fixed to the outer surface of said handle and covering one of said slots;

stop means fixed to at least one side of each tool member for engagement with the inner surface of the handle opposite to the slot covered by the support block;

a leaf spring fixed to the outer surface of the handle;

a transverse locking pin fixed to at least one end of said leaf spring and mounted for movement in a direction parallel to its axis;

at least one transverse aperture in said handle for receiving said locking pin which is resiliently biased by said leaf spring into said transverse aperture;

and at least one groove in the back edge of said tool member, said groove having a shape complementary to that of the locking pin;

whereby said locking pin engages the groove in the tool member thereby to securely lock the tool member to said handle.

2. A combination tool as set forth in claim 1, characterized in that said handle is of rectangular cross-section and said locking pin projects from the side walls of the handle.

3. A combination tool as set forth in claim 1, characterized in that the stop means is the back edge of a saw blade fixed to said tool member.

4. A combination tool as set forth in claim 1, characterized in that at least one of the side edges of said tool member has a U-shaped notch for engagement with the handle directly beyond the inner end of the slot located opposite to the support block.

5. A combination tool as set forth in claim 3, characterized in that the back edge of the saw blade fixed to said tool member extends perpendicular to the side edge of said tool member facing the tip of the saw blade.

6. A combination tool as set forth in claim 1 wherein said tool member comprises a spade blade having two parallel, axial slots, one of which has a transverse groove; and further comprising an extension handle detachably secured between said handle and said blade; the end of said extension handle detachably secured to said blade having two opposite, longitudinal slots for receiving said blade; and a transverse locking slot for receiving a second locking pin; said locking pin engageable with said transverse groove on said blade.

* * * * *